US007853161B2

(12) United States Patent
Hayase et al.

(10) Patent No.: US 7,853,161 B2
(45) Date of Patent: Dec. 14, 2010

(54) IMAGE FORMING APPARATUS WITH TONER DISCHARGE METHOD

(75) Inventors: Toru Hayase, Toyokawa (JP); Kuniya Matsuura, Toyohashi (JP); Yuusuke Okuno, Toyokawa (JP); Kentaro Katori, Toyokawa (JP); Hiromasa Ueno, Toyohasi (JP); Hideaki Hayashi, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 127 days.

(21) Appl. No.: 12/332,664

(22) Filed: Dec. 11, 2008

(65) Prior Publication Data

US 2009/0175636 A1 Jul. 9, 2009

(30) Foreign Application Priority Data

Jan. 4, 2008 (JP) ..... 2008-000019

(51) Int. Cl.
*G03G 15/08* (2006.01)
*G03G 15/00* (2006.01)

(52) U.S. Cl. ..... 399/55; 399/44; 430/120.1

(58) Field of Classification Search ..... 399/55, 399/53, 44, 285, 257; 430/120.1
See application file for complete search history.

(56) References Cited

U.S. PATENT DOCUMENTS

2004/0022549 A1* 2/2004 Ozawa et al. ..... 399/55
2008/0240759 A1* 10/2008 Kouno ..... 399/55
2009/0010666 A1* 1/2009 Okuno et al. ..... 399/55

FOREIGN PATENT DOCUMENTS

| | | |
|---|---|---|
| JP | 63-231378 | 9/1988 |
| JP | 2000-206770 A | 7/2000 |
| JP | 2000-267430 | 9/2000 |
| JP | 2001-75438 A | 3/2001 |
| JP | 2004-29104 A | 1/2004 |
| JP | 2005-70497 A | 3/2005 |
| JP | 2006-119309 | 5/2006 |
| JP | 2007-034096 | 2/2007 |

OTHER PUBLICATIONS

Decision of Grant issued in corresponding Japanese Patent Application No. 2008-000019, mailed Aug. 3, 2010, and English translation thereof.

* cited by examiner

*Primary Examiner*—Sophia S Chen
(74) *Attorney, Agent, or Firm*—Buchanan Ingersoll & Rooney PC

(57) ABSTRACT

A potential difference between the photoreceptor and the development roller is set at a value at which the normally charged toner on the development roller can be flown toward the photoreceptor in the development phase at the time of compulsorily consuming the toner, and this potential difference is set at a value at which the flown normally charged toner can be returned to the development roller in the recovery phase.

8 Claims, 6 Drawing Sheets

IMAGE FORMING APPARATUS WITH TONER DISCHARGE METHOD

This application is based on application No. 2008-000019 filed in Japan on Jan. 4, 2008, the contents of which are hereby incorporated by reference.

BACKGROUND OF THE INVENTION

1. Field of the Invention

The present invention relates to an image forming apparatus such as copying machines, printers, facsimiles and the like, and particularly to an image forming apparatus which can effectively consume oppositely charged toner of a development unit to perform development by a single component development system.

2. Description of the Related Art

In a non-contact development system in which single component non-magnetic toner is carried on a development roller as a developer and the toner is supplied to an electrostatic latent image formed on a photoreceptor to develop the image, a developing bias voltage formed by superimposing a direct current voltage on a pulsed alternating voltage is applied to the development roller. This developing bias voltage made of a development voltage and a recovery voltage. The toner is subjected to a force from the development roller toward the photoreceptor by the development voltage, and the toner is drawn back from the photoreceptor toward the development roller by the recovery voltage. The toner to which these development voltage and recovery voltage are applied alternately adheres to the electrostatic latent image on the photoreceptor to perform development.

When the single component non-magnetic toner on the development roller passes between the development roller and a regulation blade or a supply roller contacting with the development roller, a part of the toner deteriorates in charge characteristic due to friction and becomes oppositely charged toner which is charged oppositely to a normally charged toner. The oppositely charged toner causes image defects of adhering to a non-image forming section to cause fog without contributing to development and interfering with flying of the normally charged toner to reduce an image density and cause image irregularities. Particularly when printing at a low coverage rate, image defects become outstanding.

In Japanese Unexamined Patent Publication No. 2001-75438, a consumed amount of toner per unit drive time of the development roller or per unit revolution of the development roller is determined, and if this consumed amount of toner is small, that is, when it is found to be low in a coverage rate, the toner carried on the development roller is compulsorily discharged toward the photoreceptor to be consumed, and thereby the occurrence of the fog of toner or image irregularities is prevented.

However, in a constitution of Japanese Unexamined Patent Publication No. 2001-75438, it is inefficient since a predominant large amount of the normally charged toner is simultaneously discharged with the oppositely charged toner when compulsorily consuming the toner and therefore the rate at which the oppositely charged toner actually wanted to be consumed is discharged is small. Further, since the normally charged toner having a high developing property is also discharged and disposed of, this method is low in cost-effective and disadvantageous for users.

In Japanese Unexamined Patent Publication No. 2004-29104, it is proposed to compulsorily consume the oppositely charged toner in a non-image region on an image-carrier based on a consumed amount of a developer. Specifically, in the case of normally developing, the photoreceptor is charged to a charging potential (−450 V) and a portion to be a black image is diselectrified to an exposure potential (−50 V) to form an electrostatic latent image, and on the other hand, the negatively charged toner on a development sleeve is flown toward the electrostatic latent image on the photoreceptor by applying a developing bias voltage (−350 V) to the development sleeve. When the so-called reverse development, in which the oppositely charged toner is consumed, is performed, the charging potential of the photoreceptor is changed to −800 V in a region where images are not formed to compulsorily fly the positively charged toner on the photoreceptor onto the photoreceptor by a Coulomb force.

However, an adhesion force in a direction of the development roller such as an image force and a Van der Waals force is exerted on the toner on the development roller in addition to a Coulomb force. As shown in FIG. 11A, the Coulomb force increases linearly as the toner charged amount become larger. The image force increases in a quadratic manner as the charged amount of the toner increases but the Van der Waals force is constant regardless of the charged amount of the toner. Therefore the adhesion force which combines the image force and the Van der Waals force also increases in a quadratic manner with respect to the charged amount of the toner. Therefore, the Coulomb force becomes smaller than adhesion force whether a charged amount is small or large, and the toner cannot fly. A range of the charged amount at which the toner can fly is limited. As is apparent from a distribution of the charged amount of the toner shown in FIG. 11B, the oppositely charged toner generally has a small absolute value of the charged amount and a small Coulomb force.

In the foregoing Japanese Unexamined Patent Publication No. 2004-29104, the Coulomb force is increased as far as possible by enhancement of an electric field and thereby the toner is flown, but the oppositely charged toner which actually overcomes the adhesion force and can arrive at the photoreceptor is limited to infrequent toner having a large absolute value of the charged amount. Accordingly, an effect of compulsorily consuming the toner is small.

It is an object of the present invention therefore to provide an image forming apparatus which can fly the toner toward a photoreceptor to compulsorily consume the toner even though the toner is oppositely charged toner having a small charged amount and thereby can prevent image defects such as fog and irregularities caused by the accumulation of the oppositely charged toner.

SUMMARY OF THE INVENTION

In order to resolve the above-mentioned problem, the present inventors made various investigations, and consequently have noted a phenomenon in which the normally charged toner (−), which has a larger charged amount than the oppositely charged toner (+) and can fly on its own from the development roller as shown in FIG. 1, moves to and fro between the development roller and the photoreceptor by an alternating voltage, and the normally charged toner (−) beats out the oppositely charged toner (+) at the time of impinging on the development roller and flies the oppositely charged toner (+) to the photoreceptor through a recovery voltage (a development voltage for the oppositely charged toner (+)).

That is, the present invention pertains to an image forming apparatus comprising:

a photoreceptor;

a development roller carrying and supplying toner to the photoreceptor; and a power supply applying a alternating voltage comprising a development phase and a recovery phase to the development roller at non-image forming times, wherein a development duty, which shows a ratio of the development phase to a time of a cycle of the alternating voltage, and a frequency f of the alternating voltage are set in such a way that a time period in the development phase is larger than a time taken for the normally charged toner on the development roller to fly to a point located midway between the development roller and the photoreceptor and is smaller than a time taken for arriving at the photoreceptor, and a time period in the recovery phase is larger than sum of a time taken for the normally charged toner arrived at the point located midway between the development roller and the photoreceptor to arrive at the photoreceptor, a time taken for the normally charged toner arrived at the photoreceptor to return to the development roller, and a time taken for the oppositely charged toner beaten out by the normally charged toner returned to the development roller to fly from the development roller to the photoreceptor.

In accordance with the present invention, it is possible to consume only the oppositely charged toner on the photoreceptor with efficiency at the time of compulsorily consuming the toner and to prevent image defects such as fog and irregularities caused by the accumulation of the oppositely charged toner. It is also possible to selectively consume only the oppositely charged toner and to improve cost effectiveness significantly.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENT

Figure 1:
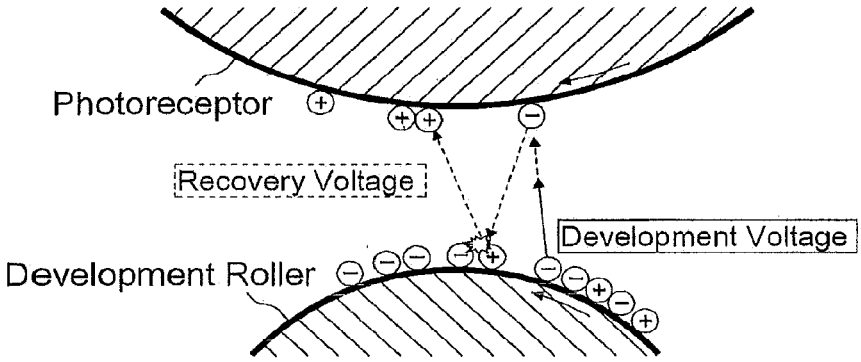
FIG. 1 is a model view showing an action of toner in a development region at the time of compulsorily consuming the toner of an image forming apparatus of the present invention.
Figure 2:
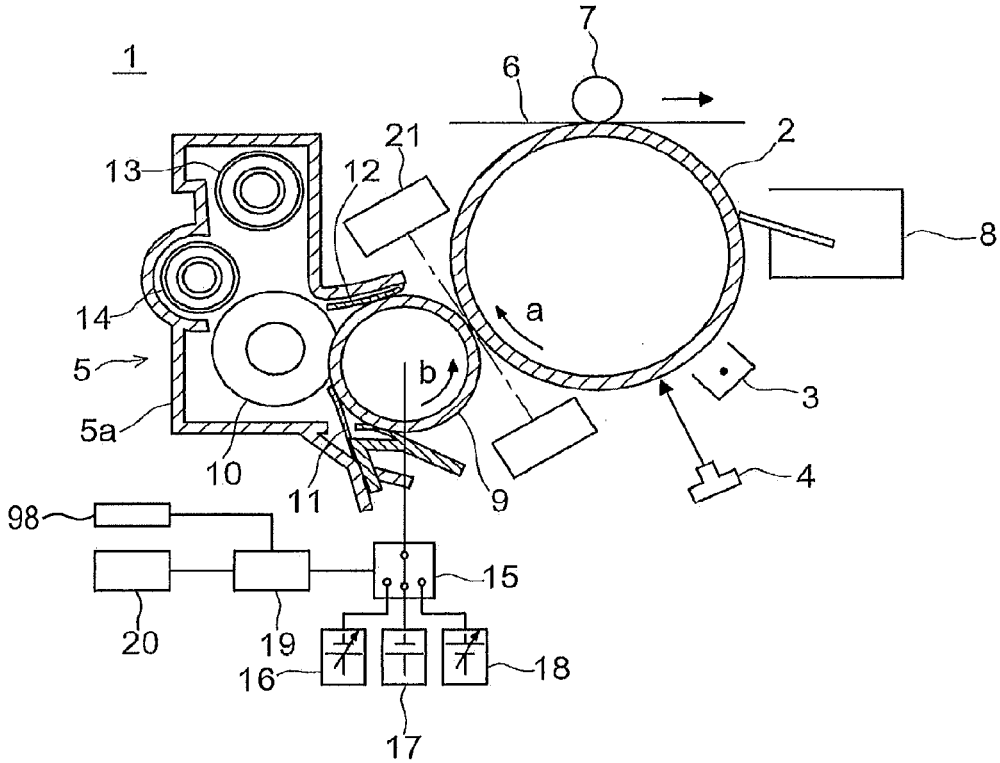
FIG. 2 is a schematic view of the image forming apparatus of the present invention.

FIG. 2 shows an image forming apparatus of the present invention. The image forming apparatus 1 includes a photoreceptor drum 2 (hereinafter, referred to as just a photoreceptor) as an image carrier which can be rotationally driven in the direction of the arrow a. A charging unit 3 to charge the photoreceptor 2 evenly, an exposure unit 4 to expose the surface of the photoreceptor 2 in response to image data signals to form electrostatic latent images, a development unit 5 which develops the electrostatic latent image on the photoreceptor 2 with the toner to form toner images, a transfer roller 7 which presses an intermediate transfer belt 6 (or paper) against the photoreceptor 2 to transfer the toner images on the photoreceptor 2 to the intermediate transfer belt 6 (or paper), a cleaning unit 8 which recovers the toner remaining on the photoreceptor 2 to clean the photoreceptor 2 are located around the photoreceptor 2.

As for the development unit 5, a development roller 9 which is opposed to the photoreceptor 2 and can be rotationally driven in the direction of the arrow band carries toner on the peripheral surface and a supply roller 10 made of a flexible foam material, which abuts against the development roller 9 and can be rotationally driven in the direction opposite to the photoreceptor 2 and supplies the toner to the development roller 9, are placed in a development casing 5*a* to house a single component nonmagnetic toner as a developer. On the development roller 9, a regulation blade 11 to charge the toner supplied to the development roller 9 and regulate a transported amount is placed so as to contact with the development roller 9. Further, an anti-static sheet 12 to diselectrify the toner remaining on the development roller 9 may be placed so as to contact with the development roller 9 for the purpose of enhancing the ability of the developed toner to be recovered. An upstream screw 13 and a downstream screw 14 to circulate the toner are further located in the development casing 5*a* so as to be rotationally driven. In the development casing 5*a*, an opening for adding the toner not shown is installed and it is adapted in such a way that the toner can be supplied from this opening when the toner becomes less.

The development roller 9 is electrically connected through a switching circuit 15 to a power supply comprising a negative variable-voltage power supply circuit 16, a negative constant-voltage power supply circuit 17 and a positive variable-voltage power supply circuit 18. A control device 19 performs switching control of the switching circuit 15 so that the alternating voltage consisting of a development phase and a recovery phase can be applied to the development roller 9 at the image forming times, a negative low voltage can be applied to the development roller 9 at the non-image forming times, and the alternating voltage consisting of a development phase and a recovery phase can be applied to the development roller 9 at the time of compulsorily consuming the toner in the non-image forming times.

By the way, in the present specification, the term "at the image forming times" refers to "at the point of transferring the toner images on the photoreceptor to the intermediate transfer belt 6 (or paper) to form images", and the term "at the non-image forming times" refers to "at the point" other than "at the image forming times", namely time prior to or posterior to the formation of images or time between the image forming times. The term "at the time of compulsorily consuming the toner" refers to "at the point of flying the oppositely charged toner on the development roller 9 to the photoreceptor side to discharge the toner "at the non-image forming times".

Next, operation of the image forming apparatus 1 comprising the foregoing constitution will be described.

Figure 3A:
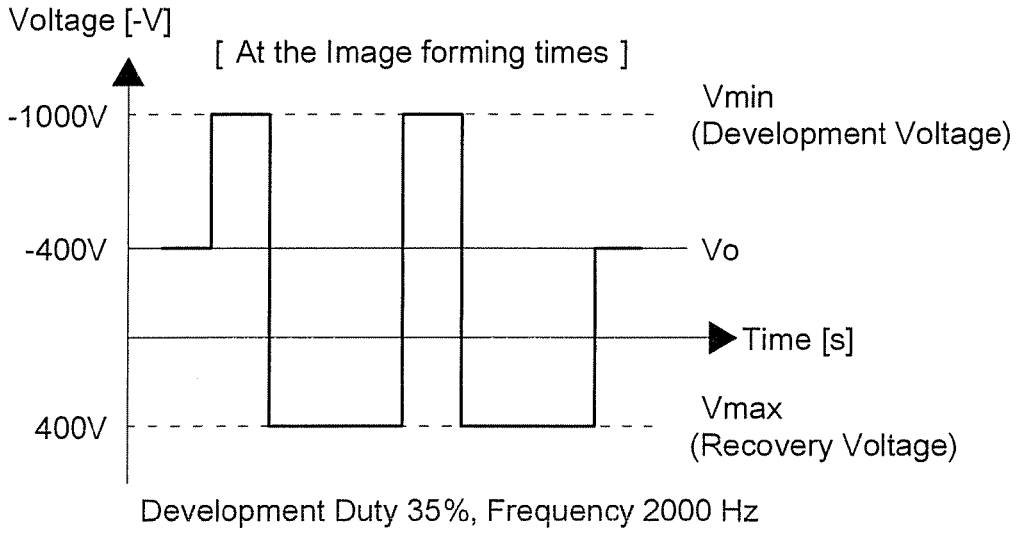
FIG. 3A is a diagram of a wave form of the alternating voltage applied the development roller at the image forming times and FIG. 3B is a diagram of a wave form of the alternating voltage applied the development roller at the time of compulsorily consuming the toner.

At the image forming times, the surface of the photoreceptor 2 is charged to a potential $V_0$ of −400 V evenly by the charging unit 3. The exposure unit 4 exposes the surface of the photoreceptor 2 based on image signals corresponding to image data to form electrostatic latent images. Rotation of the photoreceptor 2 in the direction of the arrow a causes the electrostatic latent images to move to a development region where the photoreceptor 2 is opposed to the development roller 9. The same −400 V as the photoreceptor 2 is applied to the development roller 9 at the non-image forming times. At the image forming times, an alternating bias voltage, in which a voltage component Vmin of a development phase is −1000 V and a voltage component Vmax of a recovery phase is 400 V as shown in FIG. 3A, is applied to the development roller 9. In this time, a development duty is 35% and a frequency is 2000 Hz. The normally charged toner negatively charged on the development roller 9 is flown to the photoreceptor 2 by the development voltage of the alternating bias voltage and is drawn back to the development roller 9 by the recovery voltage. Thereby, the electrostatic latent images on the photoreceptor 2 are developed evenly to form toner images. The toner images on the photoreceptor 2 are moved to a transfer section in the direction of the arrow a and the toner images are transferred to the intermediate transfer belt 6 (or paper) by the transfer roller 7.

At the non-image forming times, the toner is compulsorily consumed at a predetermined timing. This timing when the toner is compulsorily consumed can be set at every time number of images formed (number of prints) reaches 100 (this number can be set at appropriate value, for example, 50 or 300, depending on the situation), a time when a travel distance of the photoreceptor 2 exceeds 1000 mm (this value can also be set arbitrarily depending on the situation), or a time when a state of not consuming the toner based on number of dot counters continues for a certain period of time. A counter in the control device 19 which counts the number of prints since the replacement of the toner can be used for the purpose of detecting the number of prints. The number of dot counts can be determined from image data for forming electrostatic latent images on the photoreceptor 2.

Figure 3B:
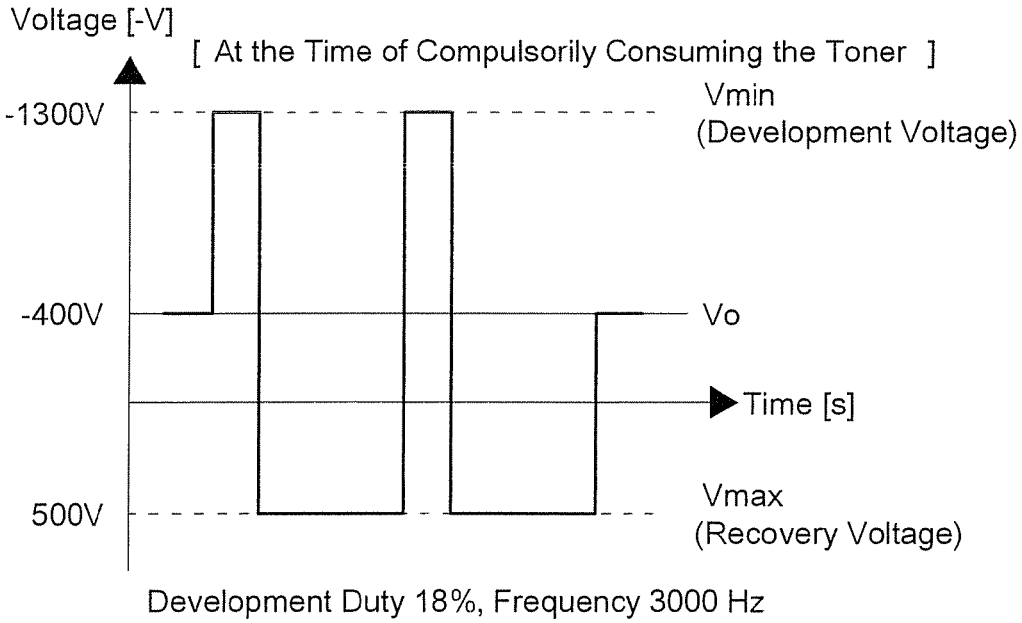

At the time of compulsorily consuming the toner, a potential $V_0$ of the surface of the photoreceptor 2 is charged to −400 V evenly by the charging unit 3 as with at the image forming times. Next, an alternating bias voltage, in which a voltage component Vmin of a development phase is −1300 V and a voltage component Vmax of a recovery phase is 500 V as shown in FIG. 3B, is applied to the development roller 9 at the image forming times.

Here, preferably, a difference between the surface potential $V_0$ of the photoreceptor and the development voltage component Vmin and a difference between the surface potential $V_0$ of the photoreceptor and the recovery voltage component Vmax are set at a large value near a leak voltage between the photoreceptor 2 and the development roller 9. That is, ΔVmin (=|Vmin−$V_0$|) and ΔVmax (=|Vmax−$V_0$|) are set at a large value without producing leak so that a Coulomb force becomes large as far as possible. Thereby, since number of toners which overcomes adhesion force toward the development roller 9 increases, number of toners which move in the development region increases. Further, since a speed at which the toner moves to and fro in the development region becomes faster, number of beating out of the oppositely charged toner can be increased.

And, a development duty and a frequency f at the time of compulsorily consuming the toner are set in such a way that beating out (pumping action) of the oppositely charged toner by the normally charged toner is effectively performed.

Figure 4:
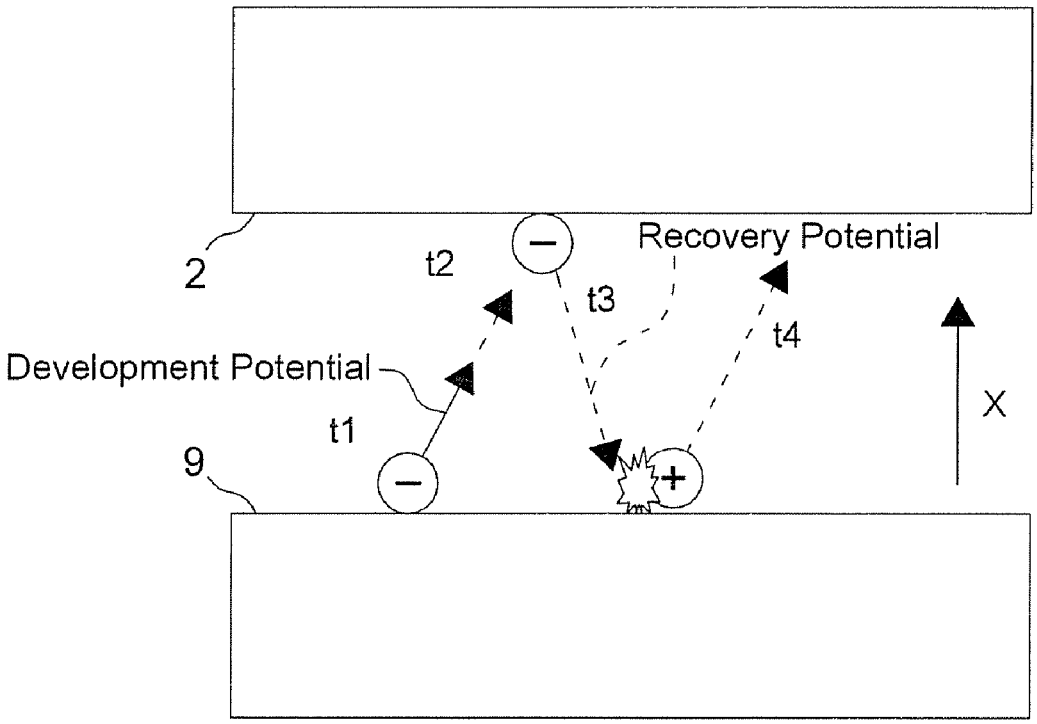
FIG. 4 is a view showing a calculation model of flight of the toner at the time of compulsorily consuming the toner.

Hereinafter, the procedure of determining the development duty and the frequency f will be described referring to a model of a phenomenon region shown in FIG. 4. In the model shown in FIG. 4, a direction from the development roller 9 to the photoreceptor 2 is taken as an x direction, and a lateral direction indicates an NIP width of development. A symbol "−" indicates the normally charged toner and "+" indicates the oppositely charged toner.

Denoting a difference between the surface potential $V_0$ of the photoreceptor and the development voltage component Vmin by ΔVmin, a difference between the surface potential $V_0$ of the photoreceptor and the recovery voltage component Vmax by ΔVmax, a mean charge of the normally charged toner by q−, a mean mass of one toner by m, and the closest distance between the photoreceptor 2 and the development roller 9 by Ds, an acceleration $a_1$ of the normally charged toner in the development phase is expressed by the equation 1.

$$a_1=-q_{-}\cdot\Delta V_{min}/m\cdot Ds \qquad \text{[Equation 1]}$$

Similarly, an acceleration $a_2$ of the normally charged toner in the recovery phase is expressed by the equation 2.

$$a_2=q_{-}\cdot\Delta V_{max}/m\cdot Ds \qquad \text{[Equation 2]}$$

In order that the normally charged toner from the development roller 9 narrowly arrives at the photoreceptor 2, the normally charged toner has to satisfy the following two conditions.

Condition 1: A velocity at the time of arriving at the photoreceptor 2 is zero Condition 2: The toner arrives at the photoreceptor 2 just in a developing time +t1

Denoting a developing time during which the development voltage is applied during the normally charged toner flies from the development roller 9 to the photoreceptor 2 by t1, and a recovery time during which the recovery voltage is applied by t2 yields the equations 3, 4 from the conditions 1, 2.

$$a_1t_1+a_2t_2=0 \qquad \text{[Equation 3]}$$

$$x_1+(a_1t_1)t_2+\tfrac{1}{2}a_2(t_2)^2=Ds \qquad \text{[Equation 4]}$$

From the equations 1 to 3, the equation 5 can be obtained.

$$t_2=(\Delta V_{min}/\Delta V_{max})t_1 \qquad \text{[Equation 5]}$$

Substituting the equation 5 into the equation 4 yields the equations 6, 7 from which a time t1 during which the normally charged toner flies from the development roller 9 to a point located midway between the development roller 9 and the photoreceptor 2, that is a developing time $t_D$, and a time t2 during which the normally charged toner flies from the point located midway between the development roller 9 and the photoreceptor 2 to the photoreceptor 2 can be given.

$$t_D = t_1 = Ds\cdot\sqrt{\frac{2m}{-q_{-}\cdot\Delta V_{min}\left(1+\frac{\Delta V_{min}}{\Delta V_{max}}\right)}} \qquad \text{[Equation 6]}$$

-continued $$t_2 = Ds \cdot \sqrt{\frac{2m}{-q_- \cdot \Delta V_{max}\left(1 + \frac{\Delta V_{max}}{\Delta V_{min}}\right)}} \quad \text{[Equation 7]}$$

A time t3 during which the normally charged toner returns from the photoreceptor 2 to the development roller 9 can be given from the equation 8.

$$t_3 = \sqrt{\{2 \cdot Ds / a_2\}} = \sqrt{\{2m \cdot (Ds)^2 / -q_- \Delta V_{max}\}} \quad \text{[Equation 8]}$$

A time t4 during which the oppositely charged toner flies from the development roller 9 to the photoreceptor 2 can be given from the equation 9.

$$t_4 = \sqrt{\{2 \cdot Ds / a\}} = \sqrt{\{2m \cdot (Ds)^2 / q_+ \Delta V_{max}\}} \quad \text{[Equation 9]}$$

A recovery time $t_R$ can be given from the equation 10.

$$t_R = t_2 + t_3 + t_4 = Ds \cdot \sqrt{\frac{2m}{\Delta V_{max}}} \left\{ \sqrt{\frac{1}{-q_- \cdot \left(\frac{1 + \Delta V_{max}}{\Delta V_{min}}\right)}} + \sqrt{\frac{1}{q_+}} + \sqrt{\frac{1}{-q_-}} \right\} \quad \text{[Equation 10]}$$

Since the development duty is a ratio of the developing time to a time of a cycle of the alternating voltage, the equation 11 can be obtained from the relationship of $Duty_{cal} = t_D / (t_D + t_R) \times 100$.

$$Duty_{cal} = \frac{\Delta V_{max}}{(\Delta V_{max} + \Delta V_{min}) + \sqrt{\Delta V_{min}(\Delta V_{max} + \Delta V_{min})} \cdot \left(1 + \sqrt{\frac{-q_-}{q_+}}\right)} \times 100 \quad \text{[Equation 11]}$$

Figure 5:
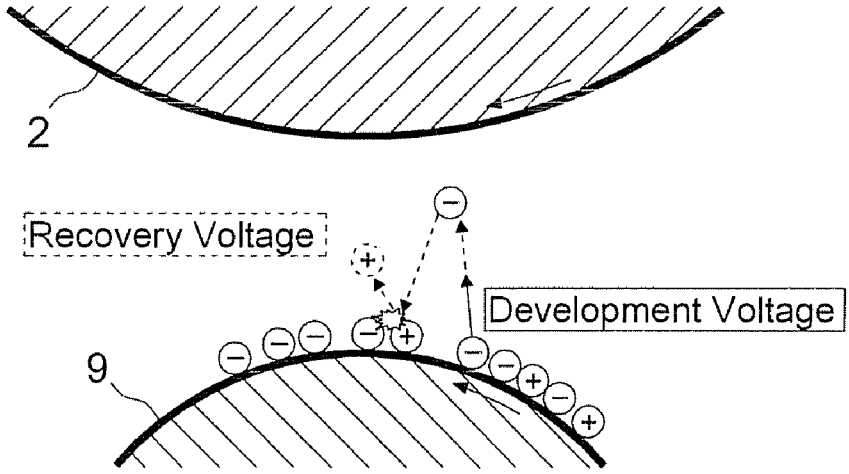
FIG. 5 is a view showing a state in which the toner flies when the development duty is low or the frequency is high.

ΔVmin; A potential difference between the surface potential of the photoreceptor and the development voltage component of the alternating voltage applied to the development roller at the time of compulsorily consuming the toner ΔVmax; A potential difference between the surface potential of the photoreceptor and the recovery voltage component of the alternating voltage applied to the development roller at the time of compulsorily consuming the toner q−; Mean charge of normally charged toner q+; Mean charge of oppositely charged toner An upper limit of the frequency f is limited by the developing time $t_D$ and the recovery time $t_R$. That is, as shown in FIG. 5, if the development duty is low or the frequency f is high, an accelerating time for the normally charged toner cannot be adequately secured. Therefore, the normally charged toner flying from the development roller 9 does not arrive at the photoreceptor 2 and the pumping does not occur. So, the frequency f is defined by an inequality, $f \leqq Duty/100 \cdot t_D$, and substituting this into the equation 6 yields the equation 12.

$$f \leq \frac{1}{Ds} \cdot \sqrt{\frac{-q_- \cdot \Delta V_{min}}{m}} \cdot \frac{Duty}{100} \quad \text{[Equation 12]}$$

Duty; Development duty

Figure 6:
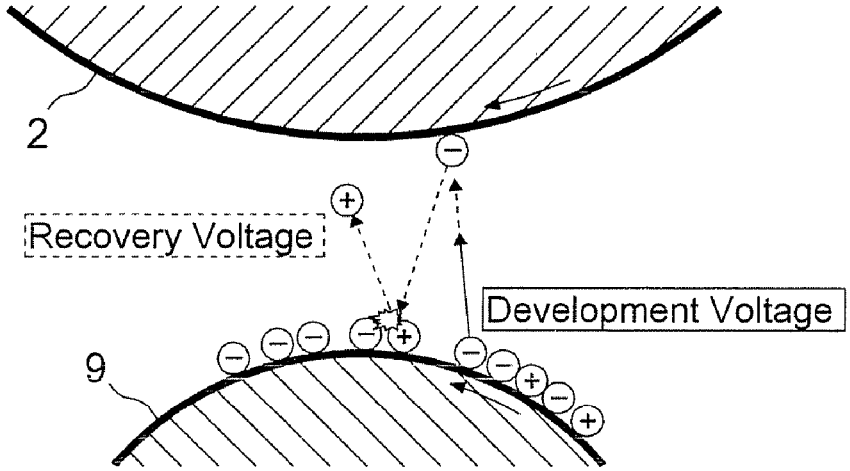
FIG. 6 is a view showing a state in which the toner flies when the recovery duty is low or the frequency is high.

ΔVmin; A potential difference between the surface potential of the photoreceptor and the development voltage component of the alternating voltage applied to the development roller at the time of compulsorily consuming the toner q−; Mean charge of normally charged toner Ds; The closest distance between the photoreceptor and the development roller m; Mean mass of one toner And, as shown in FIG. 6, if the recovery duty is low or the frequency f is high, the oppositely charged toner beaten out by the normally charged toner cannot arrive at the photoreceptor 2 even if the pumping occurs. So, the frequency f is defined by an inequality, $f \leqq (1 - Duty)/100 \cdot t_R$, and substituting this into the equation 6 yields the equation 13.

$$f \leq \frac{\sqrt{-q_- \cdot \Delta V_{max} \cdot (\Delta V_{min} + \Delta V_{max})}}{Ds \cdot \sqrt{2m} \cdot \left\{\sqrt{\Delta V_{min}} + \Delta V_{max} \cdot (\Delta V_{min} + V_{max}) \cdot \left(1 + \sqrt{\frac{-q_-}{q_+}}\right)\right.} \cdot \frac{100 - Duty}{100} \quad \text{[Equation 13]}$$

Duty; Development duty

ΔVmin; A potential difference between the surface potential of the photoreceptor and the development voltage component of the alternating voltage applied to the development roller at the time of compulsorily consuming the toner ΔVmax; A potential difference between the surface potential of the photoreceptor and the recovery voltage component of the alternating voltage applied to the development roller at the time of compulsorily consuming the toner q−; Mean charge of normally charged toner q+; Mean charge of oppositely charged toner Ds; The closest distance between the photoreceptor and the development roller m; Mean mass of one toner The lower limit of the frequency is set as follows. The present inventors have recognized that when an NIP width of the development region is 6 mm and a speed of the development roller is 450 mm/s, pumping is activated from a frequency of 2.5 kHZ when the duty is near 30%. In this time, number of waves per a development NIP=frequency×transit time of NIP=2.5×6/450=33. Accordingly, the lower limit of the frequency becomes number of waves/transit time of NIP=number of waves×speed of development roller/NIP width=5.5×speed of development roller to give the equation 14.

$$f \geqq 5.5 \cdot v_B \quad \text{[Equation 14]}$$

$v_B$; Speed of development roller

Figure 7:
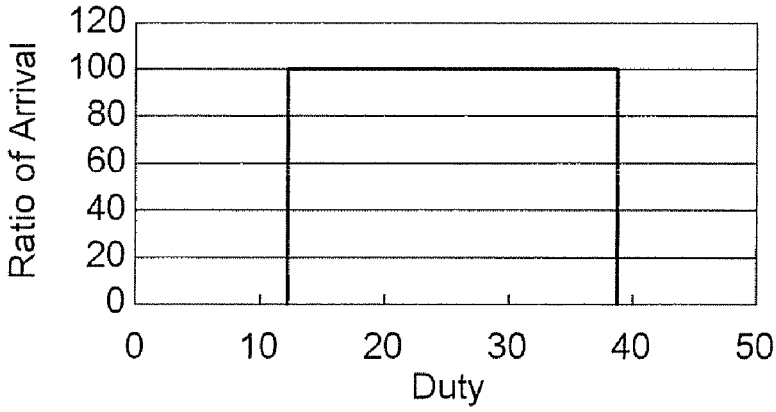
FIG. 7 is a graph showing a relationship between the development duty and a ratio of arrival of the oppositely charged toner at the photoreceptor.
Figure 8:
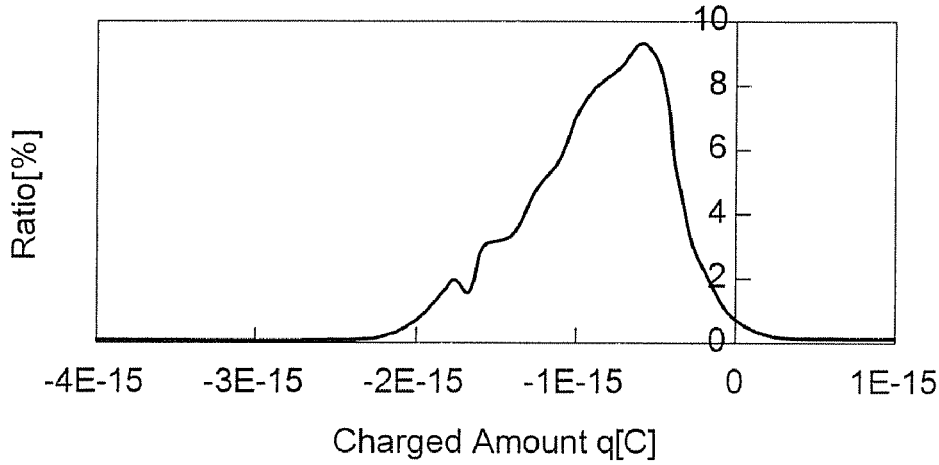
FIG. 8 is a graph showing a distribution of the charged amount of the toner.
Figure 9:
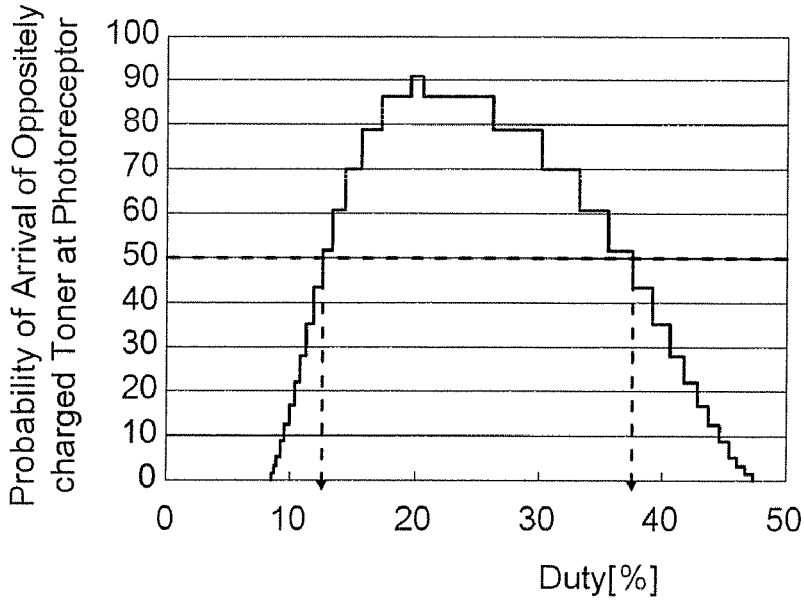
FIG. 9 is a graph showing a relationship between the development duty and a ratio of arrival of the oppositely charged toner at the photoreceptor in the case of considering a charge ratio of the toner.

The development $Duty_{cal}$ in the equation 11 is a value optimized at the upper limit of the frequency. When the frequency is a lower limit, a range of the development duty where an effect of pumping exists (a rate of arrival at photoreceptor is 100%) is expanded to developing time×frequency×100≦Duty≦(1−(recovery time×frequency))×100, and this is shown in FIG. 7. This rate of arrival is a value obtained when the charged amount of the toner is an average. However, the actual distribution of the charged amount of the toner is not uniform as shown in FIG. 8. And, a graph of a duty-rate of arrival at photoreceptor is made for each actual charged amount, and rates of arrival of the respective electrification quantities obtained by multiplying this rate of arrival by a ratio of the charged amount are summed and the result is shown in FIG. 9. From FIG. 9, a range of a duty at a time when the rate of arrival at photoreceptor is 50% is set as the equation 15. If the duty is ($Duty_{cal}-5$) or less, an application time of the development voltage is short, a probability that the oppositely charged toner arrives at the photoreceptor is 50% or less, and an effect of pumping is small. And, if the duty is ($Duty_{cal}+20$) or more, the application time of the development voltage is long but a recovery time is short, and therefore a probability that the oppositely charged toner arrives at the photoreceptor is also 50% or less and an effect of pumping is small.

$$Duty_{cal}-5 \leqq Duty \leqq Duty_{cal}+20 \quad \text{[Equation 15]}$$

Thus, the development duty can be determined in a manner to satisfy the foregoing equations 11 and 15. And, the frequency f can be determined in a manner to satisfy the foregoing equations 12, 13 and 14.

(Mean Charge of Toner q−, q+)

In the above-mentioned equations 11, 12 and 13, the mean charge q− of the normally charged toner and the mean charge q+ of the oppositely charged toner were set at $-0.9\times10^{-15}$ [C] and $2.6\times10^{-16}$ [C], respectively, from a charge average of a negative charge component and a positive charge component using a measuring apparatus of particle charged amount distribution (E-Spurt Analyzer manufactured by Hosokawa Micron Co., Ltd. of Hirakata City, Osaka-prefecture, Japan).

(Mean Mass m of Toner)

Further, since the toner is a minute particle and is difficult to measure directly, an average particle diameter was measured using a flow particle image analyzer (FPIA-2100 manufactured by Hosokawa Micron Co., Ltd.), and a volume was determined from this average particle diameter, and a mean mass m of the toner was set at $1.2\times10^{-13}$ [kg] from this volume and a specific gravity.

The foregoing mean charge q− of normally charged toner, the foregoing mean charge q+ of oppositely charged toner, and the foregoing mean mass m of toner are values in the case of using fresh toner in an environment of NN (normal temperature and normal humidity). However, an actual usage environment of the image forming apparatus is low temperature and low humidity (LL) or high temperature and high humidity (HH) and by printing at a low image rate (coverage rate) in a large amount, the toner may be deteriorated. And so, as shown in Tables 1, 2 and 3, the mean charges q−, q+ and the mean mass m of the toner at a time when the number of prints is zero (OK), 1000 (1K) and 2000 (2K) in an environment of NN, LL and HH are previously measured, and as shown in Tables 4 and 5, the mean charges q− and q+ of the toner at a time when the number of prints is zero (OK), 1000 (1K) and 2000 (2K) at a coverage rate of 0%, 5% and 10% are previously measured, and these measurements are stored in the form of table in a memory device 20, and the mean charges q−, q+ and the mean mass m of the toner are set from the foregoing table based on a detected temperature and a detected humidity by a temperature humidity sensor 98 installed in the image forming apparatus, and a coverage rate derived from the number of prints or the dot counter.

TABLE 1

| Mean charge q of normally charged toner [C] | | | |
|---|---|---|---|
| Usage environment | 0K | 1K | 2K |
| NN | $-9.2\times10^{-16}$ | $-9.6\times10^{-16}$ | $-1.0\times10^{-15}$ |
| LL | $-1.0\times10^{-15}$ | $-9.8\times10^{-16}$ | $-8.1\times10^{-16}$ |
| HH | $-9.0\times10^{-16}$ | $-9.6\times10^{-16}$ | $-1.1\times10^{-15}$ |

TABLE 2

| Mean charge $q_+$ of reversely charged toner [C] | | | |
|---|---|---|---|
| Usage | Number of prints | | |
| environment | 0K | 1K | 2K |
| NN | $2.6\times10^{-16}$ | $2.6\times10^{-16}$ | $2.6\times10^{-16}$ |
| LL | $5.9\times10^{-16}$ | $4.8\times10^{-16}$ | $3.2\times10^{-16}$ |
| HH | $2.7\times10^{-16}$ | $2.6\times10^{-16}$ | $2.7\times10^{-16}$ |

TABLE 3

| Mean mass m of toner [kg] | | | |
|---|---|---|---|
| Usage | Number of prints | | |
| environment | 0K | 1K | 2K |
| NN | $1.2\times10^{-13}$ | $1.3\times10^{-13}$ | $1.3\times10^{-13}$ |
| LL | $0.9\times10^{-13}$ | $1.1\times10^{-13}$ | $1.1\times10^{-13}$ |
| HH | $1.2\times10^{-13}$ | $1.3\times10^{-13}$ | $1.5\times10^{-13}$ |

TABLE 4

| Mean charge $q_-$ of normally charged toner [C] | | | |
|---|---|---|---|
| Coverage | Number of prints | | |
| rate | 0K | 1K | 2K |
| 0% | $-9.2\times10^{-16}$ | $-9.0\times10^{-16}$ | $-7.6\times10^{-16}$ |
| 5% | $-9.2\times10^{-16}$ | $-9.6\times10^{-16}$ | $-1.0\times10^{-15}$ |
| 10% | $-9.2\times10^{-16}$ | $-9.1\times10^{-16}$ | $-9.4\times10^{-16}$ |

TABLE 5

| Mean charge $q_+$ of reversely charged toner [C] | | | |
|---|---|---|---|
| Coverage | Number of prints | | |
| rate | 0K | 1K | 2K |
| 0% | $2.6\times10^{-16}$ | $2.5\times10^{-16}$ | $1.9\times10^{-16}$ |
| 5% | $2.6\times10^{-16}$ | $2.6\times10^{-16}$ | $2.6\times10^{-16}$ |
| 10% | $2.6\times10^{-16}$ | $2.5\times10^{-16}$ | $2.7\times10^{-16}$ |

(Distance Between Photoreceptor and Development Roller Ds)

The distance Ds between the photoreceptor and the development roller can be set at a design value, for example, 130 μm. But, the distance between the photoreceptor and the development roller may be deviate from the design value due to wear of the photoreceptor, the development roller or a roller, or variations between products. And so, the distance between the photoreceptor and the development roller may be measured at the time of compulsorily consuming the toner using a transmission displacement sensor 21 to use this measured value. And, leakage between the photoreceptor and the development roller may be detected by a leak detector, and a paschen's law (A discharge inception voltage becomes a function of a distance between electrodes) may be used to determine the distance between the photoreceptor 2 and the development roller 9 and this may be used as a set value.

If thus, q−, q+, m, and Ds are determined, and these values are substituted into the equations 1 to 5 to determine the development duty and the frequency f, the following values can be obtained. In this example, the development duty was set at 18% and the frequency f was set at 3000 Hz.

$$11.5 \leqq \text{development duty} \leqq 36.5 \quad \text{[Equation 16]}$$

$$2475\ \text{Hz} \leqq \text{frequency } f \leqq 3310\ \text{Hz} \quad \text{[Equation 17]}$$

By applying the developing bias voltage described above to the development roller 9, the normally charged toner on the development roller 9 flies toward the photoreceptor 2 at a development voltage in the development phase. When the normally charged toner reaches the point located midway in the development region, the development phase is switched to the recovery phase, but the normally charged toner arrives at the photoreceptor 2 by virtue of inertia. The normally charged toner arrived at the photoreceptor 2 is drawn back to the development roller 9 by the recovery voltage and impinges on the oppositely charged toner on the development roller 9 to beat out this oppositely charged toner. Then the oppositely charged toner flies toward the photoreceptor 2 by the recovery voltage (development voltage for the oppositely charged toner) and is consumed on the photoreceptor 2.

Figure 10:
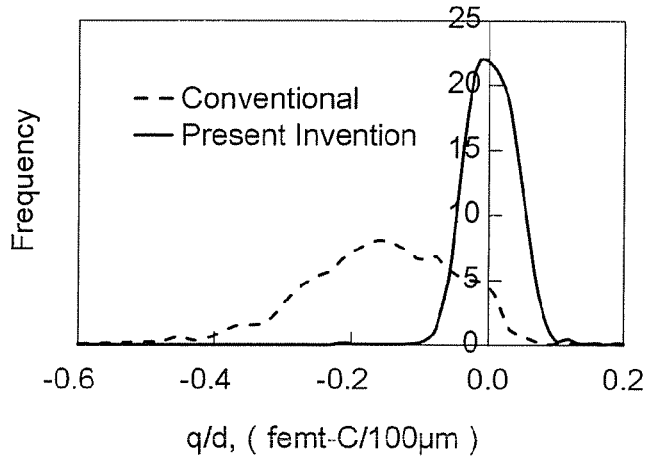
FIG. 10 is graph comparatively showing charge distributions of the toner on the photoreceptor at the time of compulsorily consuming the toner of the present invention and the conventional constitution.
Figure 11:
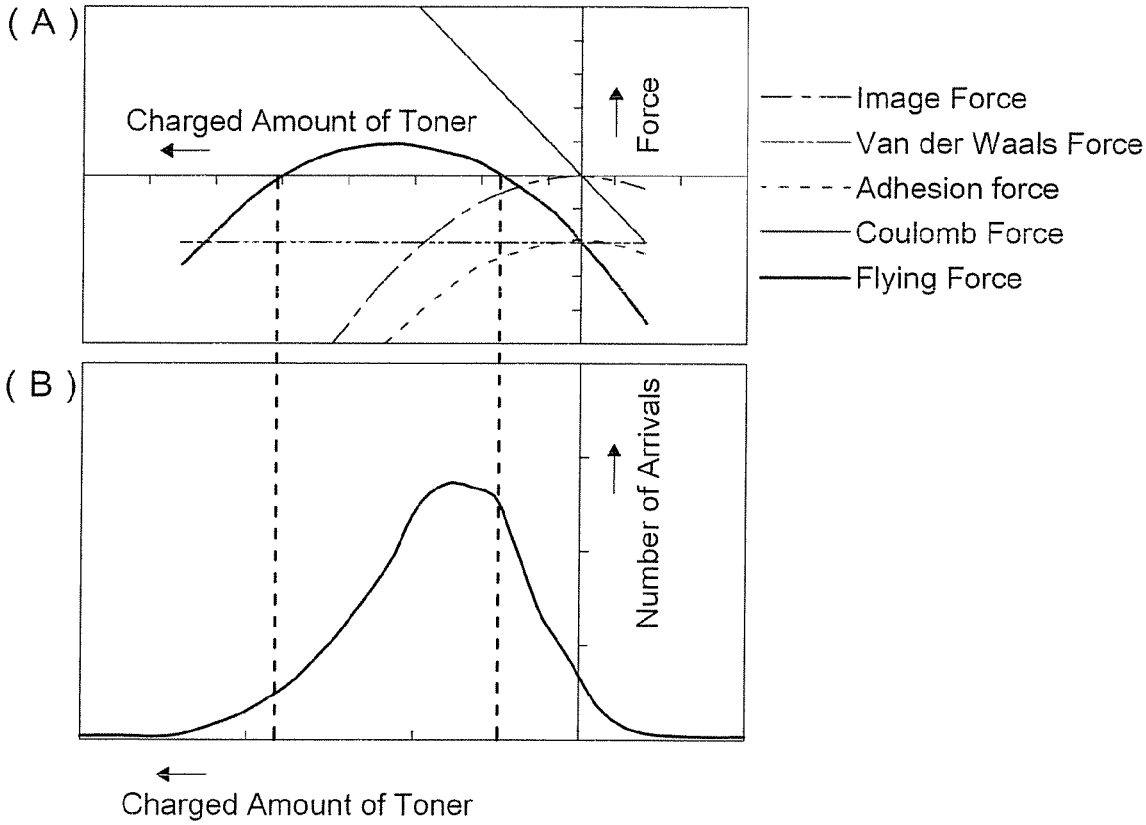
FIG. 11A is a graph showing various forces exerted on the normally charged toner and FIG. 11B is a graph showing a charge distribution of the toner.

FIG. 10 shows a charge distribution of the toner on the photoreceptor at the time of compulsorily consuming the toner in accordance with the present invention and a charge distribution of the toner on the photoreceptor in accordance with a conventional constitution in which the same developing bias as that at the image forming times is applied at the time of compulsorily consuming the toner. It was found from this that in the conventional constitution, a consumption rate of the oppositely charged toner which one really should consume is small but in the present invention, much oppositely charged toner could be consumed.

Although the present invention has been fully described by way of the examples with reference to the accompanying drawing, it is to be noted that various changes and modifications will be apparent to those skilled in the art. Therefore, unless such changes and modifications otherwise depart from the spirit and scope of the present invention, they should be construed as being included therein.

What is claimed is:

1. An image forming apparatus comprising:

a photoreceptor;

a development roller carrying and supplying toner to the photoreceptor; and a power supply applying an alternating voltage comprising a development phase and a recovery phase to the development roller at non-image forming times, wherein a development duty, which shows a ratio of the development phase to a time of a cycle of the alternating voltage, and a frequency f of the alternating voltage are set in such a way that a time period in the development phase is larger than a time taken for the normally charged toner on the development roller to fly to a point located midway between the development roller and the photoreceptor and is smaller than a time taken for arriving at the photoreceptor, and a time period in the recovery phase is larger than sum of a time taken for the normally charged toner arrived at the point located midway between the development roller and the photoreceptor to arrive at the photoreceptor, a time taken for the normally charged toner arrived at the photoreceptor to return to the development roller, and a time taken for the oppositely charged toner beaten out by the normally charged toner returned to the development roller to fly from the development roller to the photoreceptor.

2. The image forming apparatus according to claim 1, wherein the development duty satisfies the following equations (1) and (2), the frequency f of the alternating voltage satisfies the following equations (3), (4) and (5):

$$Duty_{cal} = \frac{\Delta V_{max}}{(\Delta V_{max} + \Delta V_{min}) + \sqrt{\Delta V_{min}(V_{max} + \Delta V_{min})} \cdot \left(1 + \sqrt{\frac{-q_-}{q_+}}\right)} \times 100 \quad (1)$$

$$Duty_{cal} - 5 \leq \text{Duty} \leq Duty_{cal} + 20 \quad (2)$$

$$f \leq \frac{1}{Ds} \cdot \sqrt{\frac{-q_- \cdot \Delta V_{min}}{m}} \cdot \frac{\text{Duty}}{100} \quad (3)$$

$$f \leq \frac{\sqrt{\frac{-q_- \cdot \Delta V_{max} \cdot (\Delta V_{min} + \Delta V_{max})}{\Delta V_{max} \cdot (\Delta V_{min} + V_{max}) \cdot \left(1 + \sqrt{\frac{-q_-}{q_+}}\right)}}}{Ds \cdot \sqrt{2m} \cdot \left\{\sqrt{\Delta V_{min}} + \right.} \cdot \frac{100 - \text{Duty}}{100} \quad (4)$$

$$f \geq 5.5 \cdot v_B \quad (5)$$

where,

ΔVmin [V] is a potential difference between a surface potential of the photoreceptor and a development voltage component of the alternating voltage applied to the development roller at a time of compulsorily consuming the toner, ΔVmax [V] is a potential difference between the surface potential of the photoreceptor and a recovery voltage component of the alternating voltage applied to the development roller at the time of compulsorily consuming the toner, Ds [m] is the closest distance between the photoreceptor and the development roller, Duty is the development duty, q− [C] is a mean charge of the normally charged toner, q+ [C] is a mean charge of the oppositely charged toner, m [kg] is a mean mass of one toner, and $v_B$ [mm/s] is a speed of the development roller.

3. The image forming apparatus according to claim 2, wherein at least any one of the mean charge q− of the normally charged toner, the mean charge q+ of the oppositely charged toner and the mean mass m of one toner is changed in accordance with the number of prints or a coverage rate.

4. The image forming apparatus according to claim 2, wherein at least any one of the mean charge q− of the normally charged toner, the mean charge q+ of the oppositely charged toner and the mean mass m of one toner is changed in accordance with temperature and humidity.

5. The image forming apparatus according to claim 2, further comprising:

a memory means to store a correspondence relationship between at least any one of the mean charge q− of the normally charged toner, the mean charge q+ of the oppositely charged toner and the mean mass m of one toner and number of prints, and a count means for counting the number of prints of the image forming apparatus, wherein a value stored in the memory means, which corresponds to the number of prints obtained from the count means, is used as the mean charge q− of the normally charged toner, the mean charge q+ of the oppositely charged toner or the mean mass m of one toner.

6. The image forming apparatus according to claim 2, further comprising:

a memory means to store a correspondence relationship between at least any one of the mean charge q− of the normally charged toner, the mean charge q+ of the oppositely charged toner and the mean mass m of one toner and temperature humidity conditions, and a temperature-humidity sensor to detect ambient temperature and humidity of the image forming apparatus, wherein a value stored in the memory means, which corresponds to the temperature humidity conditions obtained from the temperature-humidity sensor, is used as the mean charge q− of the normally charged toner, the mean charge q+ of the oppositely charged toner or the mean mass m of one toner.

7. The image forming apparatus according to claim 2, further comprising:

a distance measuring means to measure a distance between the photoreceptor and the development roller, wherein the distance obtained from the distance measuring means is used as the closest distance Ds between the photoreceptor and the development roller.

8. A toner discharging method for discharging toner from a development roller to a photoreceptor, comprising:

setting an alternating voltage comprising a development phase and a recovery phase, wherein a development duty, that is a ratio of the development phase to a time of a cycle of the alternating voltage, and a frequency f of the alternating voltage are set in such a way that a time period in the development phase is larger than a time taken for a normally charged toner on the development roller to fly to a point located midway between the development roller and the photoreceptor and is smaller than a time taken for arriving at the photoreceptor, and a time period in the recovery phase is larger than sum of a time taken for the normally charged toner arrived at the point located midway between the development roller and the photoreceptor to arrive at the photoreceptor, a time taken for the normally charged toner arrived at the photoreceptor to return to the development roller, and a time taken for an oppositely charged toner beaten out by the normally charged toner returned to the development roller to fly from the development roller to the photoreceptor; and applying the alternating voltage to the development roller at non-image forming times.

* * * * *